US007489787B2

(12) United States Patent
Macey

(10) Patent No.: US 7,489,787 B2
(45) Date of Patent: Feb. 10, 2009

(54) SPA AUDIO SYSTEM

(75) Inventor: Steve Macey, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 471 days.

(21) Appl. No.: 10/364,080

(22) Filed: Feb. 11, 2003

(65) Prior Publication Data

US 2003/0169889 A1 Sep. 11, 2003

Related U.S. Application Data

(63) Continuation of application No. 09/516,132, filed on Mar. 1, 2000, now Pat. No. 6,556,684.

(51) Int. Cl.
*H04R 1/02* (2006.01)

(52) U.S. Cl. ..... 381/89; 381/386; 411/107; 4/541.1; 601/47

(58) Field of Classification Search ..... 381/89, 381/87, 332, 150, 152, 386; 264/241, 239; 411/107, 103, 81; 4/541.1, 538, 546; 601/47
See application file for complete search history.

(56) References Cited

U.S. PATENT DOCUMENTS 2,890,297 A * 6/1959 Lehr ..... 381/345
4,410,768 A * 10/1983 Nakamura et al. ..... 381/423
4,506,117 A 3/1985 Fresard
4,575,882 A * 3/1986 Diamond ..... 4/559
4,757,548 A * 7/1988 Fenner, Jr. ..... 381/189
5,335,284 A 8/1994 Lemons
5,339,804 A * 8/1994 Kemp ..... 601/2
5,369,868 A * 12/1994 Ohaus ..... 29/458
5,473,700 A * 12/1995 Fenner, Jr. ..... 381/336
5,557,150 A 9/1996 Variot et al.
5,601,680 A 2/1997 Kuszaj et al.
5,619,582 A * 4/1997 Oltman et al. ..... 381/82
6,556,684 B1 * 4/2003 Macey ..... 381/89

FOREIGN PATENT DOCUMENTS

JP 403015423 A * 1/1991

OTHER PUBLICATIONS

Merriam Webster's Dictionary, 1999, Tenth Edition, p. 11.*
Bergman (Publication No. DE 019902875 C1), Jul. 2000.*
Single page from a Clark Synthesis Brochure with copyright notice dated 1997.
Clark Installation & Operation Guide for Tactile Sound Transducers, with copyright notice dated 1997.

* cited by examiner

*Primary Examiner*—Vivian Chin
*Assistant Examiner*—Con P Tran
(74) *Attorney, Agent, or Firm*—Leon E. Redman

(57) ABSTRACT

A portable spa including an audio system designed to use the spa shell as the sound generating device. Transducer devices are mounted within an enclosure which is bonded to the spa shell so as couple the sound vibration energy to the shell so that sound can be heard when using the spa.

9 Claims, 2 Drawing Sheets

SPA AUDIO SYSTEM

CROSS-REFERENCE TO RELATED APPLICATIONS

This application is a continuation of application Ser. No. 09/516,132 filed Mar. 1, 2000 now for U.S. Pat. No. 6,556,684 for Spa Audio System.

BACKGROUND OF THE INVENTION

1. Field of the Invention

The subject invention relates generally to spas and more particularly to an audio system utilizing a spa shell as a sound-generating device.

2. Description of Related Art

Existing spa audio systems use traditional speakers wherein the audio drivers are exposed to the harsh spa environment and/or require protection or esoteric materials to prevent premature failure. Existing spa audio systems also suffer from the limited space available to mount speakers. The resultant smaller speakers are incapable of producing full range audio (50 Hz-17 kHz).

SUMMARY OF THE INVENTION

According to the invention, a spa shell is employed as an audio driver with audio transducers mounted inside the skirt of the spa. The inventor has found that the spa shell provides both sufficient rigidity for high frequency reproduction and a sufficiently large surface area to achieve low frequency reproduction.

BRIEF DESCRIPTION OF THE DRAWINGS

The just summarized invention will now be described in detail in conjunction with the drawings of which.

DETAILED DESCRIPTION OF THE PREFERRED EMBODIMENTS

Figure 1:
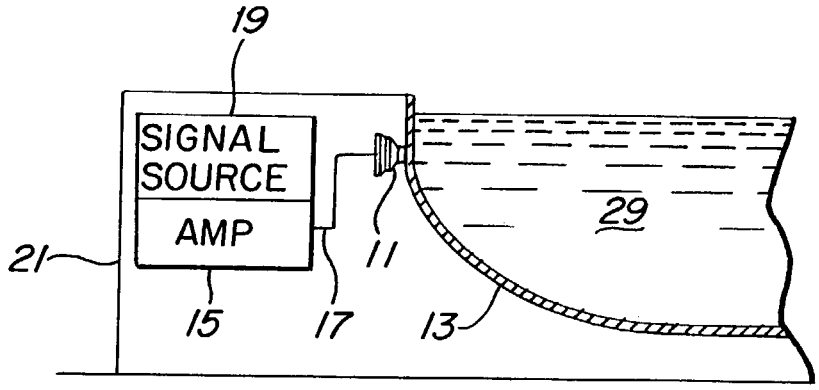
FIG. 1 is a schematic cross-sectional diagram illustrating a spa audio system according to the preferred embodiment.

FIG. 1 illustrates a spa audio system according to a preferred embodiment. According to this embodiment, audio transducer devices 11 are bonded to a spa shell 13. The transducer devices 11 couple the second vibration energy so that sound can be heard when using the spa. Two transducer devices 11 are preferably provided for stereo effect but one device or more than two devices may also be used. The transducer devices 11 may be driven by a conventional integrated audio amplifier 15, providing, e.g., 100-300 watts per channel.

The spa shell 13 is rigid enough to support the weight of water and bathers but is sufficiently compliant to reproduce full range audio. A typical spa shell 13 is formed of a thermoset plastic or a thermoplastic top sheet that has a thickness of 0.100-0.300 inches. As is well known in the spa shell art, a layer of structural foam (not shown) is applied to the underside of the shell 13 to provide insulation and structural support to the top sheet. Of course, other materials and dimensions providing the functional prerequisites for water/bather support and audio transmission may be employed.

Rigid engagement of each transducer device 11 to the spa shell 13 is required. The installation method preferably prevents spa insulation material, the structural foam layer applied to the underside of shell 13, from contaminating the transducer/shell coupling. This is achieved by constructing the transducer device 11 as a formed enclosure that surrounds a transducer element and installing it to the spa shell 13 before the insulation material is applied to the underside. A suitable audio transducer element is Model TST 329 as available from Clark Synthesis, Inc., 8122 S. Park Lane, Littleton, Colorado 80120.

Figure 2:
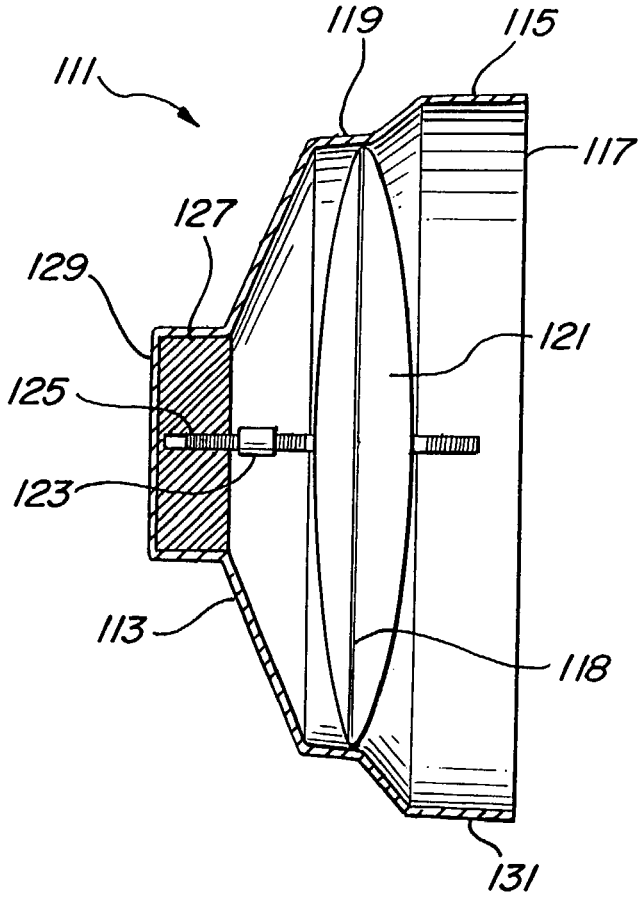
FIG. 2 illustrates an enclosure apparatus for attaching transducers to the spa shell.

An illustrative formed enclosure 111 is shown in FIG. 2. This enclosure 111 includes a thermoformed molded plastic housing 113, which may be fabricated, for example, from ⅛" ABS plastic. The housing 113 includes an outer cylindrical shell portion 115, which provides a circular rim or edge 117, which is open.

Adjacent the open rim 117 of the enclosure 111, a somewhat smaller concentric cylindrical portion 119 is provided, which is of a diameter selected to support the outer rim 118 of the transducer element 121. A nut 123 is threaded onto a threaded projection of the transducer 121 and receives a threaded end of a stud 125. The stud 125 threads into a cylindrical plug or puck 127 formed of plastic or metal at a closed end 129 of the housing 113, thereby attaching and further supporting the transducer 121 within the housing 113.

Attachment of the housing 113 and the cylindrical puck 127 to the spa shell 13 is preferably provided by using a thermoplastic glue for bonding the end 129 of the housing 113 to the shell 13 (FIG. 1), or structural foam 14 could also be used to bond the housing 113 to the shell 13. The puck 127 is then bonded by gluing, or some other equivalent means to the inside of the housing 113 at the closed end 129. The puck 127 in the housing 113 is bonded to the underside of shell 13 by the structural foam underside 14 of the spa shell 13 surrounding the housing 113, as well as by the glue.

Additionally, support to the lower end 131 of the housing 113 may be provided, for example, via a brace attached to the spa frame structure at the lower end 131 of the housing in order to relieve any shear stress created by hanging the housing/transducer assembly off the side of the spa shell 13. A hatch or door in the spa skirt 21 (FIG. 1) may also be provided to access the speaker enclosures 111 through the open ended rim 117 of housing 113.

Figure 3:
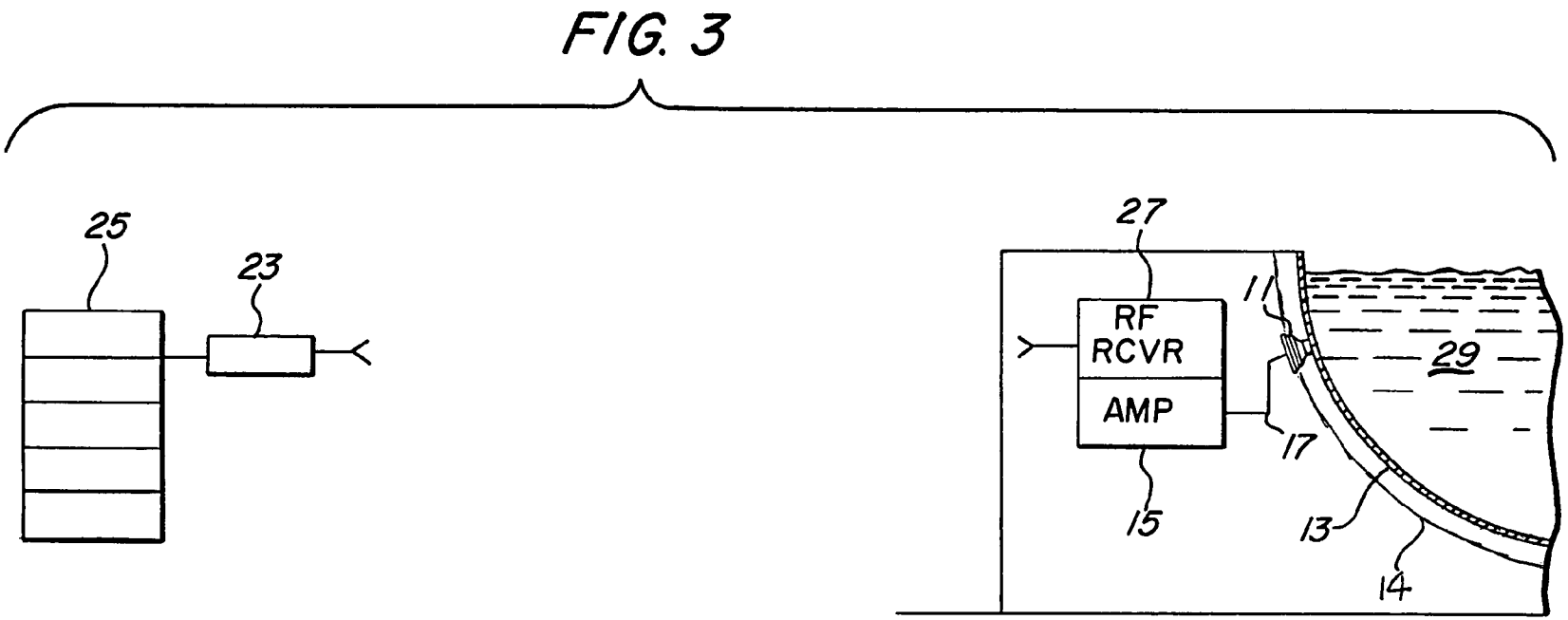
FIG. 3 is a schematic diagram of an alternate embodiment employing an RF transmitting device.

The output signal of the amplifier 15 may be coupled to the transducers via conventional speaker wire 17. In such case, the amplifier 15 and audio components 19 supplying it, such as preamplifiers and/or CD players, may be located in a compartment within the spa skirt 21 or elsewhere. Alternatively, as shown in FIG. 3, a remote transmitting device 23 (e.g., RF) may be used to enable use of a homeowner's home audio system 25 as the music signal source. Such remote transmitting devices are commercially available, for example, the 900 MHz or 2.4 GHz wireless receiver/transmitters provided by X-10 USA, Closter, N.J. 07624. In such case, a receiver 27 located at the spa provides the home audio signal to the amplifier 15, which then drives the transducers 11.

In operation, the audio can be heard under water 29 as well as above the water 29. Listeners outside the spa can also hear the audio signal, but the experience is muted compared to that of the tub occupant.

As may be appreciated, the preferred embodiment permits the audio transducer devices to be enclosed within the spa, providing improved aesthetics by eliminating exposed speaker locations. Enclosing the transducer devices within the spa also protects them from water and reduces the risk of water exposure to electrical signals.

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A spa audio system comprising:

a spa shell having a top sheet and an underside layer;

a puck having a fixed circumference and thickness formed from a solid material bonded to the spa shell by the underside layer and contained, at least in part, by the underside layer;

an audio transducer contained within a housing having a vibrating surface, the vibrating surface of the audio transducer being physically attached to the puck for coupling sound vibration energy into the puck;

an enclosure having an open and a closed end, the closed end of the enclosure being bonded to the spa shell by the underside layer and contained, at least in part, by underside layer; and wherein the puck is glued into the inside of the enclosure at the closed end, the audio transducer with a housing being located inside the enclosure at the open end.

2. The spa audio system of claim 1 further including an amplifier located adjacent to said spa shell for supplying an audio signal to said transducer.

3. The spa audio system of claim 2 further including radio frequency transmission means for transmitting a user home audio signal to a radio frequency receiver means located adjacent to said spa shell.

4. The spa audio system of claim 1 wherein the closed end of the enclosure is bonded to the spa shell by an adhesive that may be any one of the group consisting of ABS glue, fiberglass, permalite, and structural foam.

5. The spa audio system of claim 1 wherein said enclosure has a first cylindrical portion at the closed end thereof and a second cylindrical portion at the open end wherein a circular rim of the transducer housing is mounted.

6. An acoustically active hot tub comprising:

a. a shell formed of a thermoplastic top sheet and a layer of different material applied to its underside;

b. a plurality of pucks, each puck having a fixed circumference and thickness formed from a solid material bonded to the spa shell by the different material applied to the underside of the top sheet and contained, at least in part, by the different material; and c. a plurality of audio transducers, each transducer contained within a housing having a vibrating surface, the vibrating surface of the audio transducer being physically attached to a puck, for coupling sound vibration energy into the puck, said audio transducers adapted to accept signals from a sound source and transform them into vibrations that are transferred to the respective attached puck, wherein the vibrating surface of said audio transducers are attached to respective pucks by threaded shaft.

7. The hot tub of claim 6, further comprising:

a. a sound source integrated within said hot tub; and b. speaker wires connecting each of said audio transducers to said sound source.

8. The hot tub of claim 7 further comprising a cover enclosing the housing of each one of said audio transducers.

9. The hot tub of claim 6 wherein the different material may be one of the group consisting of fiberglass, permalite, and structural foam.

* * * * *